US009944454B2

(12) United States Patent
Haage

(10) Patent No.: US 9,944,454 B2
(45) Date of Patent: Apr. 17, 2018

(54) SPRAY CONTROL DEVICE FOR AEROSOL CANS

(71) Applicant: Gregory A. Haage, Golden Valley, MN (US)

(72) Inventor: Gregory A. Haage, Golden Valley, MN (US)

( * ) Notice: Subject to any disclaimer, the term of this patent is extended or adjusted under 35 U.S.C. 154(b) by 0 days.

(21) Appl. No.: 15/250,894

(22) Filed: Aug. 29, 2016

(65) Prior Publication Data

US 2017/0362013 A1 Dec. 21, 2017

Related U.S. Application Data

(60) Provisional application No. 62/211,683, filed on Aug. 28, 2015.

(51) Int. Cl.

| | |
|---|---|
| ***B67B 1/00*** | (2006.01) |
| ***B65D 83/20*** | (2006.01) |
| ***B65D 47/26*** | (2006.01) |
| ***B65D 83/22*** | (2006.01) |
| ***B65D 83/24*** | (2006.01) |
| ***B65D 83/48*** | (2006.01) |

(52) U.S. Cl.

CPC ..... *B65D 83/205* (2013.01); *B65D 47/261* (2013.01); *B65D 83/22* (2013.01); *B65D 83/24* (2013.01); *B65D 83/48* (2013.01)

(58) Field of Classification Search

CPC ..... B65D 83/16; B65D 83/20; B65D 83/205; B65D 83/22; B65D 83/24; B65D 83/48; B65D 47/261

See application file for complete search history.

(56) References Cited

U.S. PATENT DOCUMENTS

| | | | | |
|---|---|---|---|---|
| 2,598,308 A | | 5/1952 | Samuels et al. | |
| 2,887,273 A | | 5/1959 | Anderson et al. | |
| 3,083,872 A | | 4/1963 | Meshberg | |
| 3,088,679 A | | 5/1963 | Ford | |
| 3,178,077 A | | 4/1965 | Benedetto | |
| 3,180,536 A | | 4/1965 | Meshberg | |
| 3,185,350 A | * | 5/1965 | Abplanalp | B65D 83/205 222/402.11 |
| 3,249,260 A | * | 5/1966 | Goldberg | B65D 83/205 222/153.1 |
| 3,284,007 A | | 11/1966 | Clapp | |
| 3,305,144 A | | 2/1967 | Beres et al. | |

(Continued)

*Primary Examiner* — Patrick M Buechner
(74) *Attorney, Agent, or Firm* — Albert W. Watkins

(57) ABSTRACT

A spray control apparatus for aerosol cans has a can coupling cap with a segmented and discontinuous aerosol can engaging ring. The cap top lip has a locking ledge having a bearing surface facing away from the can engaging ring, a cam track having a bearing surface facing toward the can engaging ring, and a guide slot therebetween. A plurality of generally planar reinforcing ribs radiate inwardly from the cap side wall. An actuator is concentrically within the cap, and has at least one cam protruding radially into the cap top lip. The cam engages the locking ledge bearing surface in a first rotary position and is thereby blocked from axial movement, and engages the cam track bearing surface in a second rotary position and is thereby driven axially toward the can engaging ring, and passes though the guide slot when rotated between the first and second rotary positions.

7 Claims, 5 Drawing Sheets

(56) References Cited

U.S. PATENT DOCUMENTS 3,363,968 A 1/1968 Williams
3,373,908 A * 3/1968 Crowell ..... B65D 83/205 222/402.13
3,387,911 A 6/1968 Focht
3,426,948 A * 2/1969 Stirling ..... B65D 83/205 222/402.11
3,591,128 A * 7/1971 Ramis ..... B65D 83/20 222/402.11
3,632,024 A 1/1972 Usen
3,703,994 A 11/1972 Nigro
3,721,423 A 3/1973 Shay
3,729,119 A 4/1973 Sette et al.
3,729,120 A 4/1973 Sette et al.
3,795,350 A 3/1974 Shay
3,795,366 A 3/1974 McGhie et al.
3,804,296 A 4/1974 Webster
3,844,448 A 10/1974 Sette
3,848,778 A 11/1974 Meshberg
3,860,149 A 1/1975 Hagianis
3,863,816 A 2/1975 Focht
3,894,665 A 7/1975 Swenson
4,065,036 A 12/1977 Kirk, Jr.
4,440,325 A 4/1984 Treuhaft et al.
4,542,837 A 9/1985 Rayner
4,720,046 A * 1/1988 Morane ..... B65D 83/205 222/190
4,773,567 A 9/1988 Stoody
4,775,081 A * 10/1988 Morane ..... B65D 83/205 222/402.13
5,027,986 A 7/1991 Heinzel et al.
5,110,231 A 5/1992 Monteith et al.
5,337,926 A 8/1994 Drobish et al.
5,385,303 A 1/1995 Gosselin et al.
5,540,359 A 7/1996 Gobbel
5,639,026 A 6/1997 Woods
5,957,337 A 9/1999 Bettison, Jr.
5,971,230 A 10/1999 Tanaka
6,029,862 A 2/2000 Jones
6,062,432 A 5/2000 Estrada
6,126,044 A 10/2000 Smith
6,345,775 B1 2/2002 Purvis, II et al.
6,349,854 B1 2/2002 Bierend et al.
6,382,473 B1 * 5/2002 Mekata ..... B65D 83/205 222/402.14
6,382,527 B1 5/2002 Dukes et al.
6,446,842 B2 9/2002 Stern et al.
6,536,633 B2 3/2003 Stern et al.
6,564,977 B2 5/2003 Uemura et al.
6,655,607 B2 12/2003 Vazquez
6,758,373 B2 7/2004 Jackson et al.
6,866,165 B2 3/2005 Heathcock et al.
6,874,663 B2 4/2005 Scheindel
6,877,643 B2 4/2005 Schneider
6,896,205 B2 5/2005 Purvis, II et al.
6,899,253 B2 5/2005 Uemura et al.
6,926,172 B2 8/2005 Jaworski et al.
6,932,244 B2 8/2005 Meshberg
6,971,552 B2 12/2005 Meshberg
7,017,785 B2 3/2006 Lasserre et al.
7,204,393 B2 4/2007 Strand
7,757,905 B2 7/2010 Strand et al.
8,333,304 B1 12/2012 Haage
8,444,026 B2 5/2013 Adams et al.
8,499,984 B2 8/2013 Strand
8,998,041 B2 4/2015 Strand
9,242,416 B1 * 1/2016 Ohm ..... B29C 73/166
9,511,927 B1 * 12/2016 Schumacher ..... B05B 12/02
2002/0017575 A1 2/2002 Andrews et al.
2003/0209569 A1 * 11/2003 Jackson ..... B65D 83/206 222/402.11
2004/0026454 A1 2/2004 Meshberg
2005/0184093 A1 * 8/2005 Brunerie ..... B65D 83/206 222/153.11
2007/0039979 A1 * 2/2007 Strand ..... B65D 83/206 222/402.11
2007/0235474 A1 * 10/2007 Downey ..... B65D 83/205 222/153.11
2008/0041889 A1 * 2/2008 Geier ..... B65D 83/205 222/402.11
2008/0164285 A1 * 7/2008 Hygema ..... B65D 83/205 222/153.11
2010/0089950 A1 * 4/2010 Helf ..... B65D 83/206 222/153.09

* cited by examiner

Fig. 1
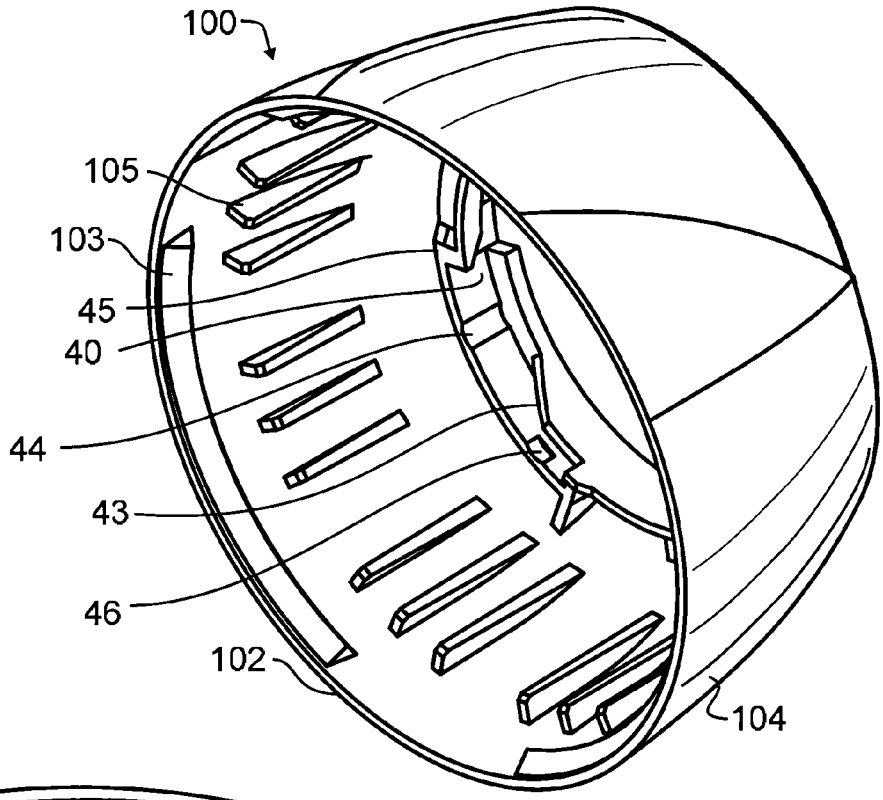
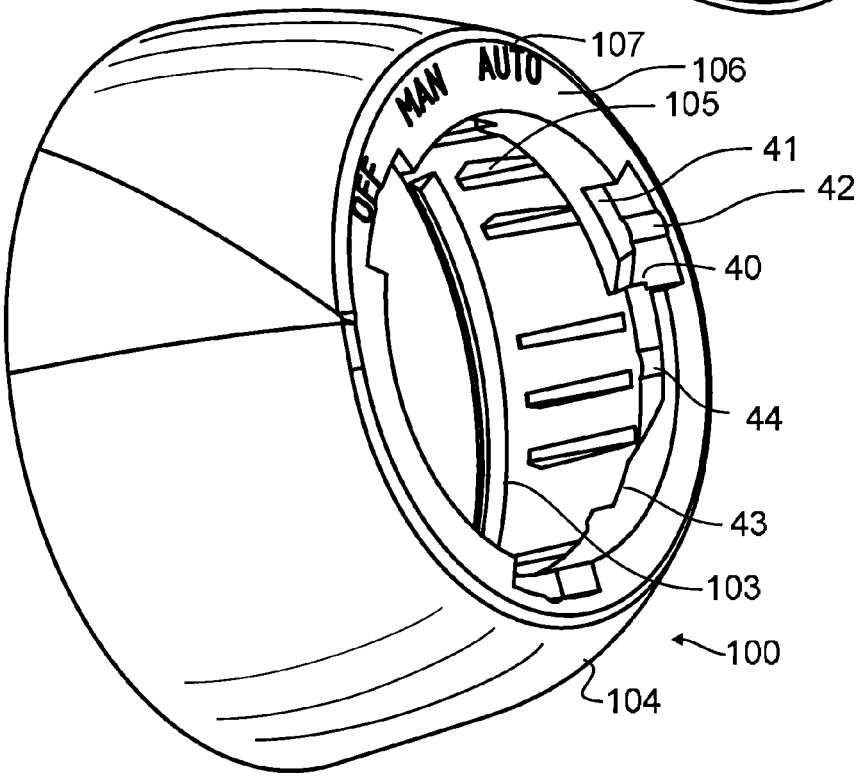
Fig. 2

SPRAY CONTROL DEVICE FOR AEROSOL CANS

CROSS REFERENCE TO RELATED APPLICATIONS

The present application claims the benefit of U.S. provisional patent application 62/211,683 filed Aug. 28, 2015 of like title and inventorship, the teachings and entire contents which are incorporated herein by reference.

BACKGROUND OF THE INVENTION

1. Field of the Invention

This invention pertains generally to the field of dispensing, and more particularly to a fluid dispenser which includes a securing device maintaining the dispenser in an open, closed, or manually controlled state.

2. Description of the Related Art

The primary tools for applying paint, many which have been used by homeowners for centuries, include brushes, rags, cloth and even woolen or fur applicators. When painting a small-to-mid size surface, such as a room wall or the like, such techniques have always been reasonably economical. In fact, there are few homes that are not cluttered with a collection of various pint, quart and gallon paint cans that contain the various paint mixtures of previous painting projects. Often, there will also be a clutter of various sizes and ages of brushes, frequently stiffened by old paint that was never completely cleaned from the brush prior to storage.

While this approach has been used for a very long time, and is extremely commonplace in the vast majority of homes, the paint can and brush techniques have suffered from a number of undesirable shortcomings. For example, when a project is finished, such as painting a room, whatever quantity of paint remains in the can will most desirably be stored. In the event that at some later date damage occurs to the painted walls or ceiling, theoretically the homeowner may simply repair any physical damage and then re-apply the saved paint. With high quality paint, this could be years later, and the colors will still be expected to match exactly with the paint that was originally applied. The same theory applies in the case of minor remodeling or redecorating, such as the installation of a new light fixture that covers a slightly different amount of the adjacent wall surface. Unfortunately, the paint stored in ordinary paint cans has a relatively limited shelf life. The air gap present above the liquid paint acts as a large source of oxygen, which invariably leads to a degradation of the paint. Typically, at least the surface layer of the paint will harden and be unsuitable. The amount of paint which is lost to this process is frequently dependent upon some complex combination of how full the paint can is, the ingredients of the paint, and how long the can is stored. Consequently, the homeowner will never know quite what to expect when the can is opened, even only a few months later. Worse, even if there is still some usable paint in the can, it is well known that the pigments that are contained in most paints are more dense than the base. When the paint is first stored, the pigments consequently settle out, often before much hardening of the surface has occurred. Consequently, when the homeowner strips the hardened surface off of the paint and then mixes the remaining usable paint in the ordinary manner, the concentration of pigments has unintentionally been increased, potentially affecting the match between the original paint and the paint now remaining in the can.

Not only is paint difficult to store in ordinary paint cans and buckets, but used brushes are equally difficult to store. A high quality brush has the unique ability to hold a great deal of paint within the interstices between the bristles. As paint is applied to a surface, the brush tip will desirably draw paint gradually from the bristles, and the brush may be used for several strokes before requiring another dip into the paint. Unfortunately, the very characteristic which makes a brush more desirable for the application of paint also makes the brush somewhat more difficult to clean. Since the paint is held within the bristle interstices, there is a tendency for the brush nearest to the handle to dry along the outer surfaces that are exposed to the air. Removal of this paint can be difficult. But, in addition to getting the dried paint off, there will also be a large amount of unused paint retained within the brush. Consequently, whether the paint is water-based or oil-based, the brush will require a large volume of appropriate cleaner or solvent just to remove the remaining wet paint that is held in the brush. This is, of course, before the dried-on paint can be removed. Even with a fairly rigorous cleaning, the brush will almost always still have some paint remaining, and over time and with more use, the brush will harden up and become useless. In the end, a diligent person will spend a great deal of time and cleaner cleaning up a high quality brush, only to still eventually throw the expensive brush away.

Another drawback with the traditional tools and methods of paint application is in the control of the amount of paint applied, and control over the surface finish. Most brush-applied paints are generally relatively thick, to avoid unwanted runs that might otherwise occur on a vertical wall immediately after a brush has been dipped into paint. In addition, thick paint will drip much less from the brush. However, this thicker paint invariably leads to the creation of a pattern of brush strokes that will remain even after the paint is dried. While brush strokes are desired in some instances to add texture, the painter rarely can control this, since thin paints will run and drip, and thicker paints retain the brush stroke. Moreover, with thicker paint the painter must pass the brush over the same area several times to ensure that the entire surface is covered. Otherwise, all too commonly there will be an occasional "streak" where the paint was applied either too thinly or not applied at all. As will also be apparent, the application of thicker paint also results in the consumption of a relatively large amount of paint. Where a color of great contrast is being used to cover another, a thick application may be desired. The converse, where there is little contrast between the two colors, often requires only a relatively thin coat of paint. Unfortunately, with a brush there is little control available.

Yet another drawback comes when a non-traditional surface is to be painted. For example, machinery such as automobiles, lawn equipment, wheel barrows and wagons, metal railings, stone, concrete, brick and mortar, and many other surfaces may require painting from time to time around a typical house. In some of these cases, a very thin and smooth coat of paint is highly desirable, such as on a typical smooth metal surface. In contrast, a very thick coat of paint is often desirable on a very rough surface, such as on concrete or bricks and mortar. Again, with a brush there is little control available.

There have been a number of well-received inventions more recently which have overcome some of the foregoing deficiencies of traditional painting. For example, there have been a number of new paint applicators that have been developed that give a homeowner more control over the thickness, and even the texture, of a coat of paint. Among these applicators are the various paint rollers and paint pads that have various "naps" or applicator surfaces that will hold more or less paint, and may be designed to form varying textures during application. Nevertheless, these various applicators still rely upon paint storage cans and interstices of one form or another within the applicator. In addition, and in spite of the many new applicators that have been developed, homeowners still invariably resort to brushes to form at least a part of the set of painting tools used for the relative simplicity and control found therein. Further compounding the problem is the knowledge that, when it comes to non-traditional surfaces, many of these more modern tools that are used to apply coats of paint are unsuited to these non-traditional surfaces. While improved can seals and geometries have also been developed, these fail to resolve the problems of long term storage within a paint can.

Commercial paint sprayers overcome many limitations of prior art applicators and typically enable an operator to apply large volumes of paint rapidly, with substantial control over the fineness and density of the spray mist. These sprayers may simply use pressurized air, or may combine additional techniques such as electrostatic attraction and the like to further improve the control and quality of spray. Unfortunately, these commercial sprayers are generally quite expensive, often require special knowledge and training to operate, require more care to clean and store than an ordinary homeowner will provide, and require storage space that is already scarce in most homes. Consequently, few homeowners would consider investing in a commercial sprayer. Finally, these commercial paint sprayers rely upon cans or pails of paint which present the same problems with storage and aging as already described herein above.

In order to offer homeowners, hobbyists and the like a greater range of flexibility than paint rollers, brushes, pads, and the like, and to more closely emulate the quality obtained by a commercial paint sprayer, manufacturers have developed various paint spray cans over the last half-century that combine paint with propellant in a self-contained can. These spray cans have met with much commercial success, since they provide the homeowner a high quality paint spray without the burden of large storage space, high initial purchase prices, and maintenance. The homeowner or hobbyist will simply spray the desired paint, and then typically tilt the can upside down to release a small amount of propellant without paint, to clear the nozzle. Then the spray cap is replaced, and the can may be stored for great lengths of time. With more modern valves and propellants, such paint cans may be stored for many years and then re-used with results in both color and quality unchanged by time.

However, these spray cans differ from the commercial sprayers in several important and undesirable ways. Spray cans are practically limited to operation in either an on or off mode, and the user cannot readily control or vary the amount of spray discharged. The pattern produced by the nozzle, the rate of discharge, and the desired particle size are each selected by the paint manufacturer, and none are readily changed or controlled by the painter. In addition, and as an undesirable side-effect of the ease of use of a spray can, when a child gains access to the can much harm may be done.

A number of artisans have worked with and improved upon the basic spray can construction. Representative of these is U.S. Pat. No. 2,598,308 by Samuels et al, entitled "Controllable Spray Dispenser", the teachings and contents which are incorporated herein by reference, which illustrates a spray device with three positions, "Automatic Continuous Spray", "Push Button Spray", and "Locked Position". This apparatus comprises a special cap that fits on an aerosol can, where the cap is made to slide upon a protruding nozzle. A slot in the cap causes the cap to slide up or down respective to the central valve. When the cap is in the locked rotational position, the cap will hit the can to prevent the central valve from being activated. When the cap is in the automatic position, a projection hits the rubber diaphragm of the valve because of force exerted between the slot in the cap and the protruding nozzle, activating the valve.

U.S. Pat. No. 3,729,120 by Sette et al, entitled "Childproof relockable actuator overcap," and U.S. Pat. No. 3,844,448 entitled "Valve actuating safety cap assembly for pressurized dispensers", the teachings and contents which are incorporated herein by reference, disclose a two-part cap that provides locking in a spray cap. While the caps illustrated therein provide adjustable spray settings, the cap is not durable, owing to the geometries of construction, and will become contaminated with paint on the top surface due to splatter and the like. Finally, since the interior and exterior sections must rotate relative to each other and there is no manual access to the interior section, the cap is not readily manually adjusted and there will be a tendency for the interior and exterior to rotate together.

U.S. Pat. No. 3,387,911 by Focht, the teachings and contents which are incorporated herein by reference, discloses a pin guided track, in association with a dispenser, for dispensing such materials as stain removers, hair coloring foam, shoe polish, dye, cleaning agents, shaving foam, and the like. The track is useful for controlling the amount of product being dispensed, but fails to provide any accommodation for factory or aftermarket misalignment. Another configuration is shown in U.S. Pat. No. 6,029,862 by Jones, entitled "Selectable Rate Actuator for Spray Cans", the teachings and contents which are incorporated herein by reference, which describes a commonly sold trigger attachment for aerosol cans that can be operated to lock the trigger from activating the aerosol spray, lock the trigger in an activated position for continuous spray, or unlock the trigger for short bursts of spray controlled by a spring assembly. Unfortunately, the Jones invention does not balance the can well, leading to significant operator fatigue. Further, the Jones invention does not readily store directly with the spray can, mandating either repeated assembly and disassembly from a spray can or causing substantial interference with the storage and access of individual spray cans.

Other patents disclosing locking spray devices have also been disclosed, the teachings and contents which are incorporated herein by reference, including U.S. Pat. No. 3,632,024 by Usen, entitled "Aerosol actuator assembly having an actuator button that is rotatable between dispensing and nondispensing positions"; U.S. Pat. No. 3,721,423 by Shay, entitled "Childproof actuator for aerosol valve"; U.S. Pat. No. 3,860,149 by Hagianis, entitled "Childproof actuator"; U.S. Pat. No. 5,957,337 by Bettison, entitled "Child resistant aerosol spray apparatus"; U.S. Pat. No. 4,773,567 by Stoody, entitled "Child resistant latching actuator for aerosol/pump valve"; U.S. Pat. No. 4,542,837 by Rayner, entitled "Aerosol actuator"; U.S. Pat. No. 5,971,230 by Tanaka, entitled "Spray quantity control nozzle for aerosol container"; U.S. Pat. No. 4,065,036 by Kirk Jr, entitled "Actuator cap having a button rotatably between dispensing and non-dispensing positions"; U.S. Pat. No. 6,349,854 by Bierend et al, entitled "Utility-power operated pressurized spray can"; and U.S. Pat. No. 6,126,044 by Smith, entitled "Lockable spray system actuator". Patents that disclose centrally rotating control of spray nozzles on aerosols, the teachings and contents which are incorporated herein by reference, include U.S. Pat. No. 5,385,303 by Gosselin et al, entitled "Adjustable aerosol spray package"; U.S. Pat. No. 6,345,775 and U.S. Pat. No. 6,896,205 by Purvis II et al, each entitled "Very high solid content aerosol delivery system".

Other patents of interest, the teachings and contents which are incorporated herein by reference, include: U.S. Pat. No. 2,887,273 by Anderson et al, entitled "Spray dispensing assembly"; U.S. Pat. No. 3,083,872 by Meshberg, entitled "Selective dispensing nozzle"; U.S. Pat. No. 3,178,077 by Benedetto, entitled "Valve actuating device"; U.S. Pat. No. 3,284,007 by Clapp, entitled "Reversible aerosol spray tip"; U.S. Pat. No. 3,703,994 by Nigro, entitled "Adjustable spray rate actuator"; U.S. Pat. No. 3,729,119 by Sette et al, entitled "Childproof overcap with horizontal spray"; U.S. Pat. No. 3,795,350 by Shay, entitled "Aerosol valve having selectable flow rate"; U.S. Pat. No. 3,795,366 by McGhie et al, entitled "Multiple spray pattern device"; U.S. Pat. No. 3,804,296 by Webster, entitled "Adjustable aerosol valve button assembly"; U.S. Pat. No. 3,848,778 by Meshberg, entitled "Childproof actuator assembly"; U.S. Pat. No. 3,863,816 by Focht, entitled "Variable flow rate actuator button for a pressurized aerosol dispenser"; U.S. Pat. No. 3,894,665 by Swenson, entitled "Safety overcap for aerosol container incorporating continuous spray mechanism"; U.S. Pat. No. 4,440,325 by Truehaft et al, entitled "Actuator"; U.S. Pat. No. 3,088,679 by Ford, entitled "Sprayers"; U.S. Pat. No. 3,180,536 by Meshberg, entitled "Selective dispensing means"; U.S. Pat. No. 3,305,144 by Beres et al, entitled "Dispenser for disposable aerosol container, with valved conduit for remote discharge of its contents"; U.S. Pat. No. 3,363,968 by Williams, entitled "Aerosol dispenser"; U.S. Pat. No. 5,027,986 by Heinzel et al, entitled "Actuating valve for aerosol foam product"; U.S. Pat. No. 5,110,231 by Monteith et al, entitled "Fluid spray cleaning system"; U.S. Pat. No. 5,337,926 by Drobish et al, entitled "Spray pump package employing multiple orifices for dispensing liquid in different spray patterns with automatically adjusted optimized pump stroke for each pattern"; U.S. Pat. No. 5,540,359 by Gobbel, entitled "Sprayer extension device"; U.S. Pat. No. 5,639,026 by Woods, entitled "Directly mountable adjustable spray nozzle"; U.S. Pat. No. 6,062,432 by Estrada, entitled "Latching aerosol cap"; U.S. Pat. No. 6,382,527 by Dukes et al, entitled "Hand-activated dispensing pump having sprayer/foamer selector wheel"; U.S. Pat. No. 6,446,842, entitled "Aerosol spray texturing devices", and U.S. Pat. No. 6,536,633, entitled "Aerosol spray texturing device with variable outlet orifice", both by Stern et al; U.S. Pat. No. 6,564,977 by Uemura et al, entitled "Cap for mounting on aerosol container"; U.S. Pat. No. 6,655,607 by Vazquez, entitled "Spray can adaptor"; U.S. Pat. No. 6,758,373 by Jackson et al, entitled "Aerosol valve actuator"; U.S. Pat. No. 6,866,165 by Heathcock et al, entitled "Spray canister"; U.S. Pat. No. 6,874,663 by Scheindel, entitled "Dispensing actuator for pressurized container"; U.S. Pat. No. 6,877,643 by Schneider, entitled "Aerosol can"; U.S. Pat. No. 6,899,253 by Uemura et al, entitled "Cap for mounting on an aerosol container"; U.S. Pat. No. 6,926,172 by Jaworski et al, entitled "Total release dispensing valve"; U.S. Pat. No. 6,932,244, entitled "Aerosol dispensing device" and U.S. Pat. No. 6,971,552 by Meshberg, entitled "Aerosol dispenser"; U.S. Pat. No. 7,017,785 by Lasserre et al, entitled "Product dispensing head and packaging with variable flow"; U.S. Pat. No. 7,757,905 by Strand et al, entitled "Spray actuator"; and US published applications 2002/0017575 by Andrews et al, entitled "Spray head" and 2004/0026454 by Meshberg, entitled "Aerosol dispensing device".

In spite of the substantial consideration and development that has occurred through the years, these patents are deficient in being capable of adequate operation with modern spray cans, in occupying minimal space, in functioning with the simplicity of a standard spray can, and in other manners that will become apparent.

In addition to the foregoing patents, my previous U.S. Pat. No. 8,333,304 entitled "Select-a-spray", the teachings and contents which are incorporated herein by reference, also illustrates a selectable spray system. While that invention overcomes many of the prior deficiencies, there remains a desire to reduce the number of piece parts and assembly required, to further improve upon that invention.

Additionally, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a spray control apparatus for aerosol cans that has a dispersion nozzle, and a conduit configured to couple a fluid and propellant contained within a spray container to the dispersion nozzle. A can coupling cap has an outer perimeter and an interior surface defining an interior space, a base, a sidewall rising from the base, a top lip distal to the base, and a can engaging ring adjacent to the base. The can coupling cap is configured to couple rigidly to the spray container. The top lip comprises a locking ledge having a bearing surface facing away from the can engaging ring, a cam track having a bearing surface facing toward the can engaging ring, and a guide slot there between. An actuator is affixed to the conduit and dispersion nozzle and is located concentrically within the can coupling cap sidewall. The actuator has a generally cylindrical body and at least one cam protruding radially from the generally cylindrical body into the top lip. The at least one cam engages the locking ledge bearing surface when the actuator is in a first rotary position relative to the can coupling cap and is thereby blocked from axial movement toward the can engaging ring and engages the cam track bearing surface when in a second rotary position relative to the can coupling cap and is thereby driven toward the can engaging ring, and passes though the guide slot when rotated between the first and second rotary positions.

In a second manifestation, the invention is a can coupling cap configured to engage with a spray control apparatus actuator and an aerosol can. The can coupling cap has an outer perimeter; an interior surface defining an interior space; a base; a sidewall rising from the base; a top lip distal to the base; and a segmented can engaging ring adjacent to the base configured to couple rigidly to the aerosol can. A plurality of reinforcing ribs of generally planar geometry radiate inwardly from the cap side wall and extend generally along the sidewall from adjacent the segmented can engaging ring to adjacent the top lip.

OBJECTS OF THE INVENTION

Exemplary embodiments of the present invention solve inadequacies of the prior art by providing a spray control device for aerosol cans having three or more dispensing positions. The positions in the preferred embodiment include "automatic" for continuous spray, "manual" for normal push-button control, and "off" to prevent spraying. Additional intermediate or continuously variable positions may also be provided. These positions are achieved by the rotation of a central spray button device that nests on top of an aerosol can. The central spray button device floats within a can coupling ring to accommodate any misalignment between the spray control device and spray can, and movement of the central spray button device is guided by a cam and guide track combination for predictable and repeatable control over paint or other fluid application. An actuator body is inserted through an access path and rotated into engagement with the can coupling ring, and both holds the central spray button device and also acts as one part of the cam and guide track pair. When necessary, and if so constructed, the can coupling ring and actuator body may each be removed to permit complete disassembly and cleaning.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide an apparatus for varying the dispense rate of a spray can. A second object of the invention is to provide the dispense rate control apparatus in a package which is both low-cost and intuitive to use, and most preferably configured from a minimal number of parts. Another object of the present invention is to provide the dispense rate control apparatus in a package which facilitates storage within the ordinary footprint of the spray can to which the apparatus is attached. A further object of the invention is to provide flexibility of use and capability from a spray can which more closely resembles capabilities heretofore available only from professional spray equipment. Yet another object of the present invention is to enable both original manufacture integral with a spray can and retrofit of existing cans. A further object of the invention is to ensure that a user will have access to all components that require manipulation, to ensure ease of use. An additional object of the invention is the provision of such an apparatus, which is additionally resistant to solvents such as may be used with the apparatus, and which components may be readily removed and cleaned.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which:

FIG. 1 illustrates a preferred embodiment cap that may be engaged with a modern paint can and which has been designed in accord with the teachings of the invention, from a bottom projected view looking diagonally up into the cap.

FIG. 2 illustrates the preferred embodiment cap of FIG. 1 from a top projected view looking diagonally down into the cap.

DESCRIPTION OF THE PREFERRED EMBODIMENT

Figure 7:
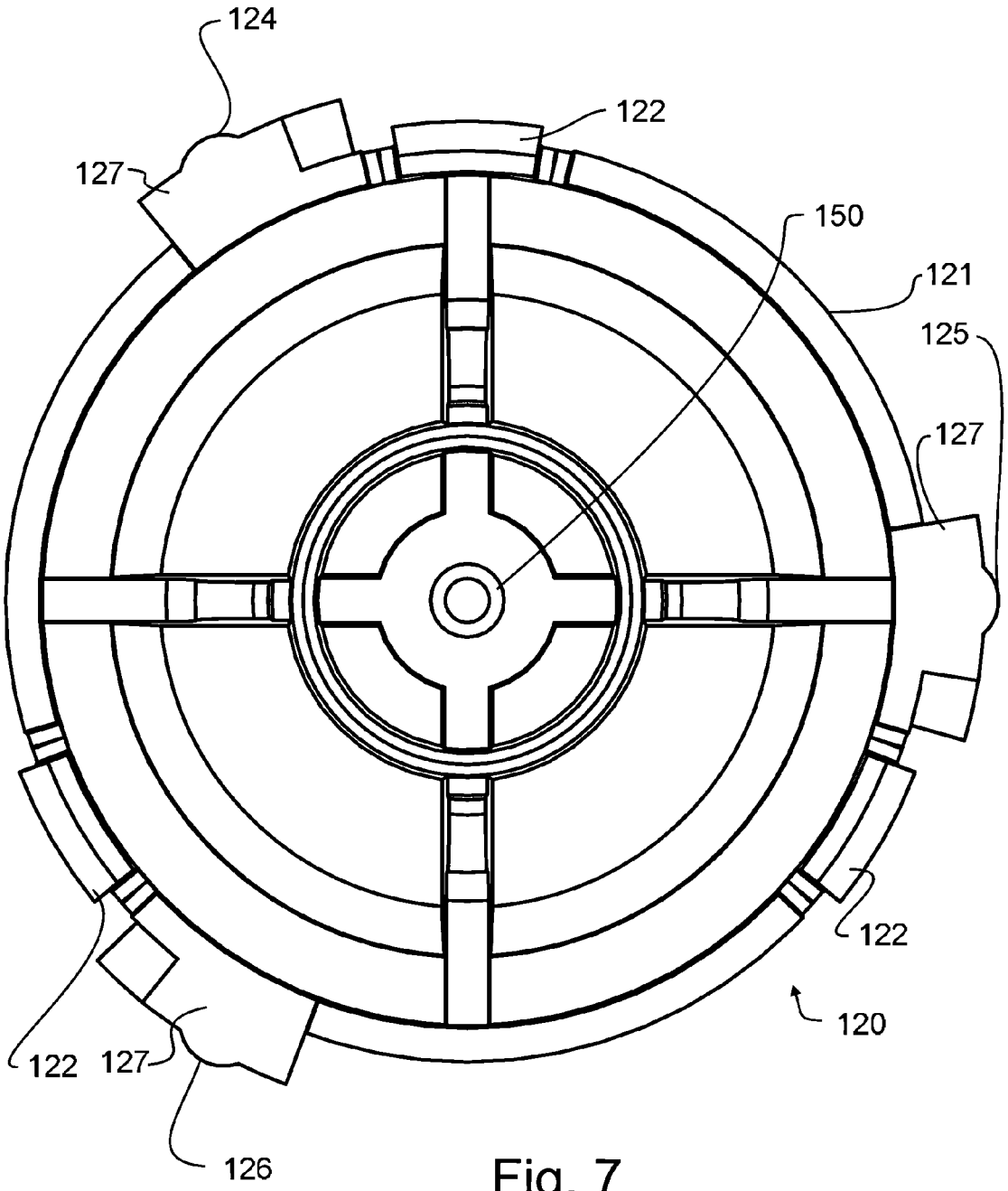
FIG. 7 illustrates the preferred embodiment actuator of FIG. 5 from bottom plan view.
Figure 8:
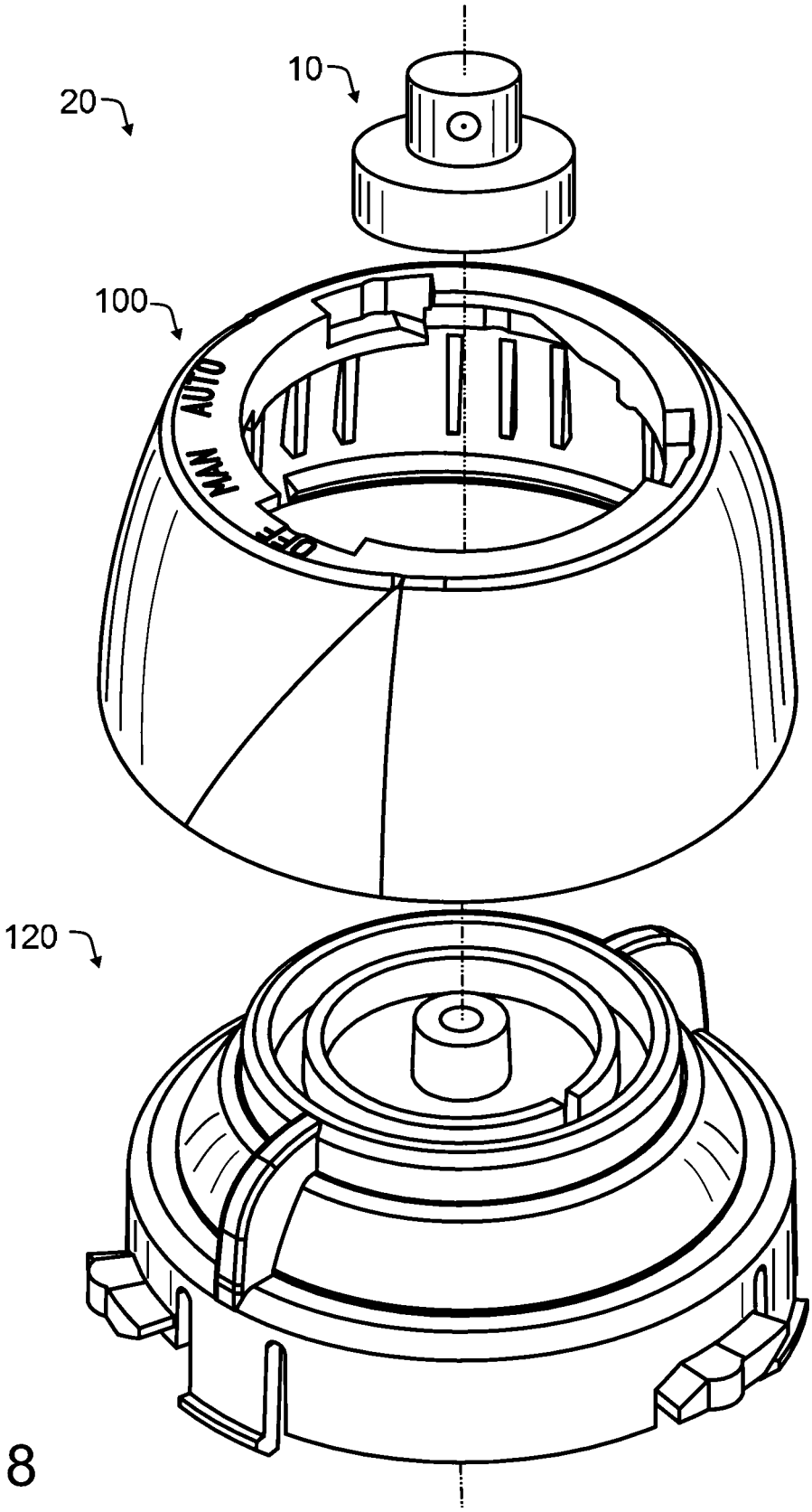
FIG. 8 illustrates a preferred embodiment spray control device for aerosol cans designed in accord with the teachings of the present invention comprising the preferred embodiment cap of FIG. 1 in combination with the preferred embodiment actuator of FIG. 5 and a prior art spray nozzle, the combination operable with a modern paint can, from an exploded and slightly projected view.

A preferred embodiment aerosol can spray control device 20 designed in accord with the teachings of the invention is illustrated in FIG. 8. A preferred embodiment cap 100, also illustrated separately in FIGS. 1-4, is configured to engage with a prior art spray can and also encompasses a preferred embodiment actuator, illustrated separately in FIGS. 5-7, and is further combined with a prior art spray nozzle. This combination defines preferred embodiment aerosol can spray control device 20, which is operable with a modern paint can. While such a paint can is not separately illustrated herein, my U.S. Pat. No. 8,333,304 entitled "Select-a-spray", the teachings and contents which were incorporated herein above by reference, illustrates a related aerosol can spray control device, and teaches therein the features of such modern but prior art paint cans and so will be understood herein. Spray nozzle 10 incorporates a conduit, which is of the type which may be commonly found inserted partially into a prior art spray can, and incorporates a pushbutton which is moved or pressed upon to activate the release of spray from the spray can, and which will additionally transport paint and propellant through to a dispersion nozzle for spraying or dispersion therefrom.

The particular design of conduit, nozzle, and pushbutton that make up spray nozzle 10 will vary greatly depending upon the particular matter being sprayed and even upon individual manufacturers and their preferences. However, and as will be apparent upon a review hereof, the present invention is well suited to any type of spray container which requires actuator depression to invoke the dispersion of the spray container contents.

FIGS. 1-4 illustrate a preferred embodiment cap 100 that is configured to be engaged with a modern paint can. Along the inner circumference adjacent to base 102 of cap 100 is a can engaging ring 103. The particular geometry of this can engaging ring 103 is not critical to the present invention. Nevertheless, there are several beneficial features found therein.

As illustrated, can engaging ring 103 is divided into several discrete segments, and has a cross-section generally in the shape of a triangular prism. This allows base 102 of cap 100 to be stretched over a rim on a prior art spray can, so that as cap 100 is pressed onto the spray can rim, the slope of the cap engaging rim gradually forces base 102 of cap 100 in the areas adjacent to the segments of can engaging ring 103 to expand. Once can engaging ring 103 passes the largest part of the paint can cap engaging rim, the slope will allow base 102 of cap 100 to return to original shape and "snap" onto the paint can cap engaging rim. This same stretch and return can be completed in reverse, allowing cap 100 to be removed from a standard prior art spray can when desired. Otherwise, cap 100 will be securely held to the paint can cap engaging rim.

Figure 3:
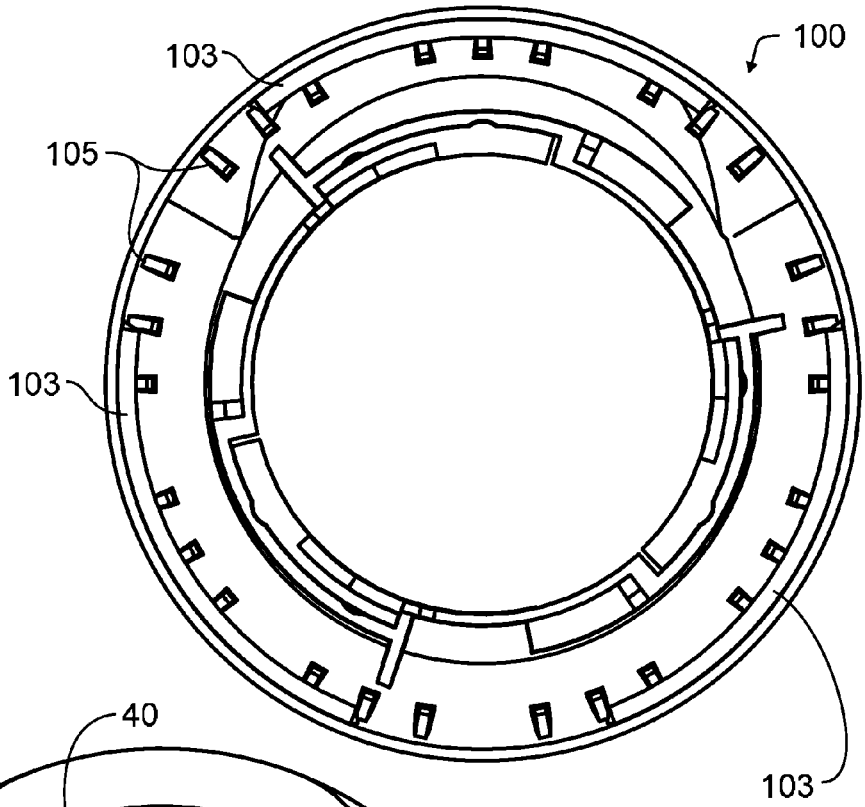
FIG. 3 illustrates the preferred embodiment cap of FIG. 1 from bottom plan view.
Figure 4:
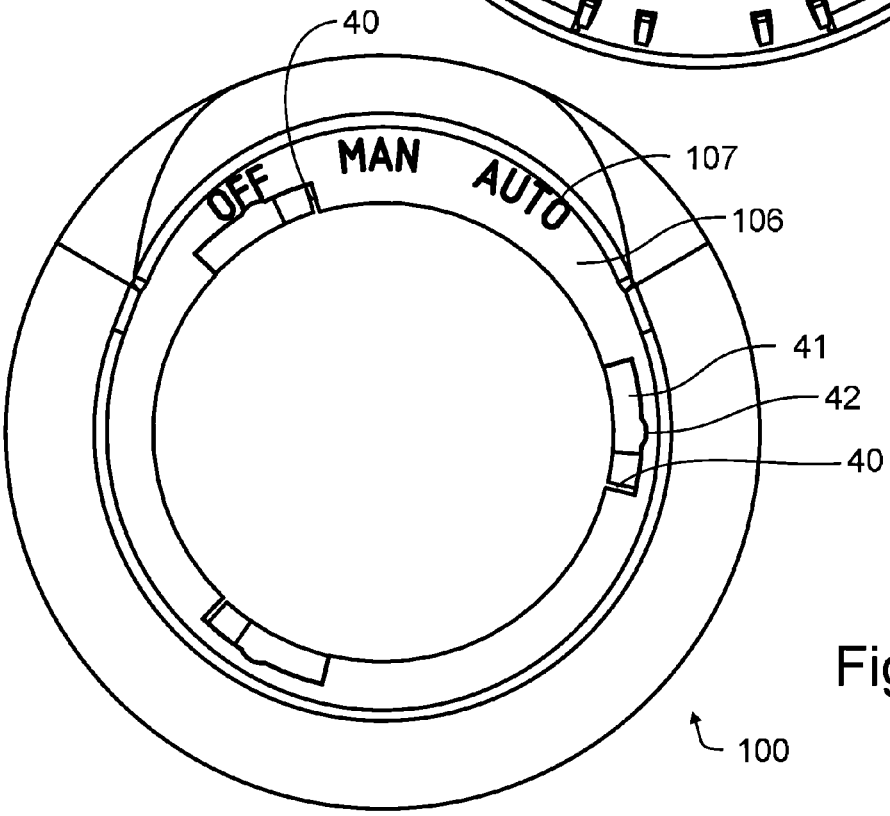
FIG. 4 illustrates the preferred embodiment cap of FIG. 1 from top plan view.

As illustrated best in FIGS. 1 and 3, the preferred embodiment can engaging ring 103 is broken into three segments, which allows the cap to expand adjacent to the can engaging ring 103 segments, and be drawn from the circular curve into a more nearly into a straight line between these can engaging ring segments adjacent to base 102. Since the shortest distance between two points is a straight line, this gap between can engaging ring 103 segments allows expansion of base 102 at the can engaging ring 103 segments, while the gaps between straighten out. In other words, by breaking ring 103 into distinct segments and providing gaps between, the cap itself acts as a spring, helping to secure the cap to the rim. The particular use of three segments is not critical to the present invention, and more or fewer segments may be provided.

Intermediate between base 102 and top lip 106 of cap 100 are a number of reinforcing ribs 105. As noted, pressing cap 100 onto a prior art can rim and removing it therefrom requires a particular combination of ability to straighten or otherwise flex between ring 103 segments, while still retaining general shape when being pressed on from top lip 106, for exemplary purposes. In other words, there must be sufficient flexibility radially to allow can engaging ring 103 to function, while also allowing a person to press hard enough on top lip 106 to cause the required flexure. Unfortunately, the vertically rising side wall 104 cannot be too thick, or the gaps between can engaging ring 103 segments will not be sufficiently flexible. Yet, this same vertically rising side wall 104 must also withstand the greatest pressing forces that a person might reasonably apply, which can be quite substantial. In order to ensure both radial flexibility and vertical stiffness, these reinforcing ribs 105 provide stiffness along the vertical axis, while ensuring flexure transverse thereto.

Adjacent to the top of cap 100, generally distal to base 102, top lip 106 incorporates a number of inventive features. On the top surface thereof, there will preferably be provided some simple labels 107 that designate the operation of the present invention, determined by the rotational orientation of actuator 120 relative to cap 100. For exemplary purposes, "off" in the illustrations designates a locked non-spray position, "man" designates manual spray operation, and "auto" for a continuous spray, the volume which is adjusted by relative rotation between cap 100 and actuator 120.

A plurality of locating detents 42, 44, 46 are preferably provided to provide tactile feedback for the locked, manual, and auto positions, respectively. These locating detents 42, 44, 46 in preferred embodiment cap 100 are simply troughs cut into the interior vertical face of top lip 106, but any suitable means or geometry that will provide the detent function is contemplated and will be considered to be incorporated herein.

The bottom surface of top lip 106 provides a face that serves as actuator retaining ridge 45. Once again, the geometry is not critical. Formed into top lip 106 are some cut-outs that in the locking position are adjacent the top of the top lip and in the manual and auto positions, adjacent to the bottom of the top lip. In the locking position, the non-cutout ledge formed in top lip 106 serves as locking ledge 41. In the manual and auto positions, the non-cutout portion forms a cam track 43.

Figure 5:
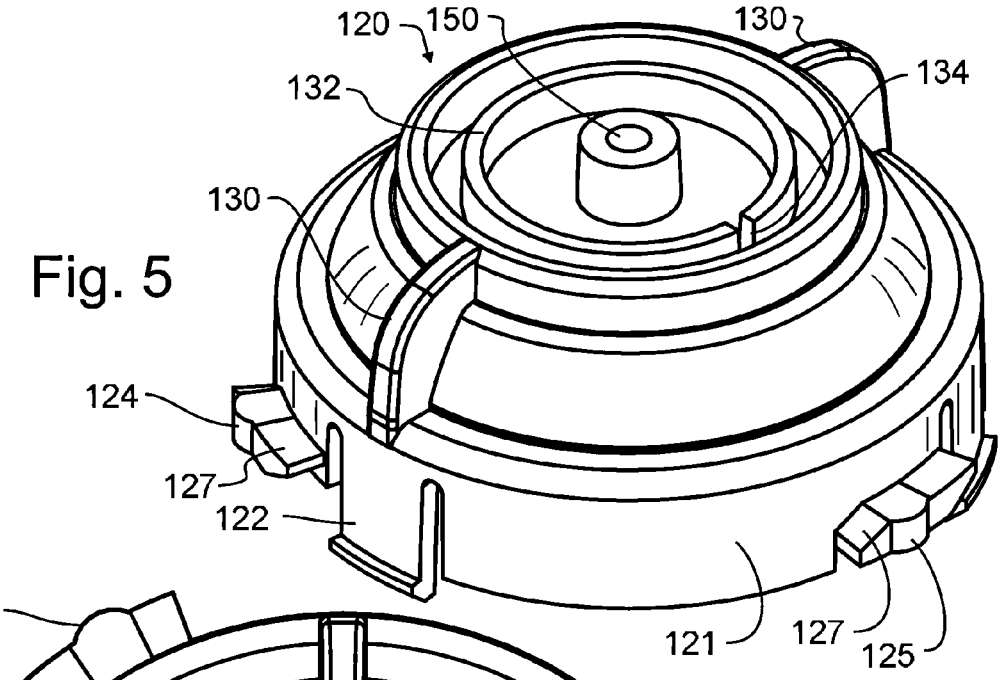
FIG. 5 illustrates a preferred embodiment actuator suitable for use in further combination with the preferred embodiment cap of FIG. 1, from projected view.
Figure 6:
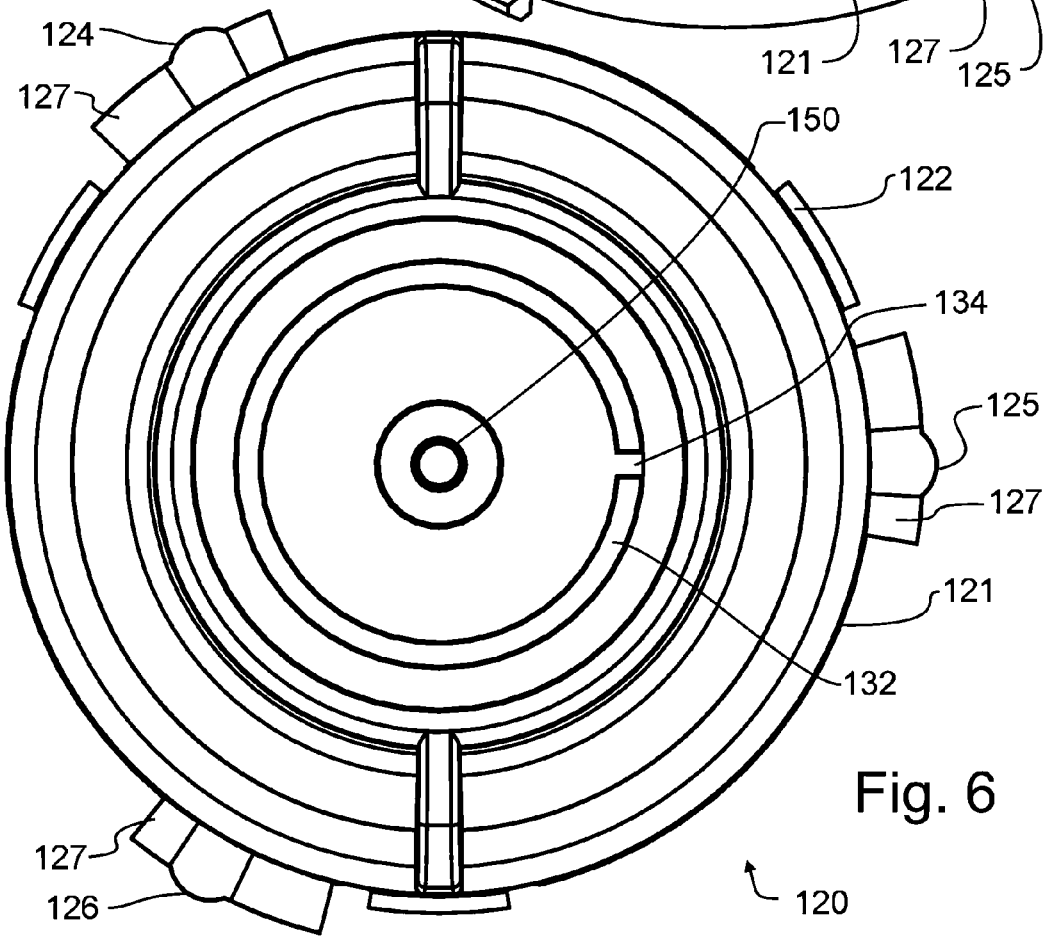
FIG. 6 illustrates the preferred embodiment actuator of FIG. 5 from top plan view.

FIGS. 5-7 illustrate a preferred embodiment actuator 120 suitable for use in further combination with preferred embodiment cap 100 of FIGS. 1-4. Actuator 120 has a retaining clip 122 that in the preferred embodiment is cantilevered, which enables spring-like resiliency. The bottom of retaining clip 122 is "L" shaped, and designed to engage with actuator retaining ridge 45 to hold actuator 120 from releasing when rotated to the "off" position.

Rotary movement of actuator 120 relative to cap 120 is accomplished by a person manually pressing against one or more rotary grips 130 preferably provided about the top periphery of actuator 120. In the preferred embodiment, two of these rotary grips 130 are provided oppositely of each other relative to the central spray conduit passageway 150, but any number and geometry of such rotary grips 130 are contemplated herein.

Extending radially from the base of actuator 120 are three cams 127 each which also include a bulging locating detent 124, 125, 126 therein. As may be appreciated, the bulging locating detents 124, 125, 126 are cooperative with cap locating detents 42, 44, 46 to provide tactile identification of the three relative rotary positions between cap 100 and actuator 120.

A small gap 134 in spray nozzle ring 132, or any other suitable visual indicator such as a scribe mark or other suitable indicator, may be used to provide visual alignment with labels 107 on the top surface of top lip 106, so both visual and tactile indicators are preferably provided. Quite simply, any suitable techniques may be used which will help a user recognize the current direction or orientation of actuator 120 with respect to cap 100, which will in turn then indicate the current setting of spray nozzle 10.

Actuator cams 127 are operative with cap cam tracks 43 to control the vertical position of actuator 120 relative to cap 100. When cams 127 are immediately above and adjacent to locking ledge 41, locking ledge 41 prevents actuator 120 from being pressed down relative to cap 100 toward a spray can. Consequently, in this position no spray may be emitted from spray nozzle 10, regardless of whether force is applied or not. This then acts as a safety lock, to prevent accidental or unintentional emission of spray, or unwanted use by a young child.

As actuator 120 is rotated from the "off" position with cams 127 engaged with locking ledge 41 to the manual position, cams 127 pass through guide slot 40 and cams 127 are now below cam track 43. In the "manual" position, cam track 43 is high enough that actuator 120 will not actuate spray nozzle 10 to trigger any release of spray from a spray can. However, since there is no ledge beneath the cam track 43 surfaces, a person pressing down on actuator 120, indirectly by pressing on spray nozzle 10, will actuate a spray can to release and spray the contents.

Further rotation of actuator 120 relative to cap 100 into the "auto" position will cause cam track 43 in contact with actuator cams 127 to drive actuator 120 down toward can engaging ring 103, and so toward a paint can. This in turn will cause the spray can to actuate. Since cam track 43 is sloped, the extent of rotation of actuator 120 will open a spray can valve more with greater relative rotation between actuator 120 and cap 100, meaning greater rotation will lead to a heavier spray. In the "auto" range of rotation, cap 100 provides all of the force driving actuator 120 toward can engaging ring 103 needed to cause the spray can to spray. This means a person can rotate actuator 120 to a desired volume of spray without ever having to press down on spray nozzle 10. In light of the present design, it will be recognized that when an operator wishes to spray for an extended period of time, a simple twist of actuator 120 to the "auto" label will cause spray to be continuously emitted, unless or until the operator again twists actuator 120 or the spray can runs out of propellant.

While only three distinct detent points are illustrated, defining the off, manual, and auto spray modes, it should also be apparent that more or fewer detent points may be provided, such as enabling an operator to spray in the automatic mode both in the full-on position and alternatively with only partial opening of the spray can. Such additional set points may be very desirable for certain applications.

The geometry of cam track 43 may be designed to provide more intuitive operation with a particular valve or family of valves. In other words, cam track 43 may be sloped such that the flow rate varies linearly for a particular number of degrees of rotation. In this case, it is likely that cam track 43 will not have a linear slope, since most spray can valves do not change volume in an entirely linear manner for a given amount of depression of the spray nozzle. Alternatively, cam track 43 may be shaped to produce other desired spray volume changes, such as exponential changes or other desired change.

Since spray nozzle 10, actuator 120, and cap 100 are already designed in preferred embodiment aerosol can spray control device 20 to be independent from a prior art spray can, another conceived combination of features is enabled by the present invention. More particularly, in the prior art can, the manufacturer had to decide for a particular spray can exactly what nozzle and spray characteristics to use. This naturally limits both the spray pattern and volumes of paint that may be emitted therefrom, and may also impact the fineness of the mist. Preferably, the present preferred embodiment aerosol can spray control device 20 is designed to accommodate a prior art spray nozzle 10 from a prior art can as a replacement for the like component used within the spray can of choice. So, if desired, a user may use exactly the nozzle chosen by the manufacturer. However, most preferably the user may also remove the spray nozzle from the conduit. The operator may also be provided with a variety of differing nozzles from which to select the most optimum spray pattern and volume for a given application, particular paint viscosity, and propellant characteristic. From a reading of the present disclosure, those reasonably skilled in the art will be able to select a suitable method of coupling actuator 120 to spray conduit. This may range from semi-permanent or permanent couplings such as adhesive or ultrasonic bonding or welding to removable and resizable couplings or methods of engagement, such as the provision of variably dimensioned fittings, o-rings, or compression fittings that engage and lock conduit to actuator 120. Where removable and resizable couplings are used, it will be understood that the conduit may be provided in different diameters, so to cooperate with different cans, simply by replacing the conduit, or, if necessary, swapping both the conduit and the couplings for other suitable combinations. While a few coupling methods are described, it will be apparent that there exist a myriad of appropriate coupling techniques in the more general joints and fittings technologies too numerous to individually enumerate herein.

An aerosol can spray control device designed in accord with the teachings of the present invention may be manufactured from a variety of materials, including metals, resins and plastics, ceramics, or even combinations or composites. The specific material used may vary, though the materials selected should be suitably solvent resistant to remain compatible with both the contents of the spray can and any cleaning solvents that may be used to clean a spray nozzle 10. The most preferred materials for the major components are polymers, which may or may not include various reinforcing fibers or particles, and other ingredients known to enhance the properties and characteristics of the composition and resulting product. The use of polymers permits volume manufacturing of suitable and relatively complex piece part geometries at relatively low cost using known techniques. Furthermore, there are a number of polymers that are resistant to nearly all solvents.

A variety of designs have been contemplated for the preferred cap and actuator, and so are not limited to the purely utilitarian appearance illustrated herein. Simulations or fantasy creations may be incorporated into the exterior appearance of the preferred cap and actuator as desired, and the materials and colors used for a particular design may be chosen not only based upon factors such as ease of manufacture and chemical resistance, but may also factor in the particular design.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

I claim:

1. A spray control apparatus for aerosol cans, comprising:

a dispersion nozzle;

a conduit configured to couple a fluid and propellant contained within a spray container to said dispersion nozzle;

a can coupling cap having an outer perimeter and an interior surface defining an interior space, a base, a sidewall rising from said base, a top lip distal to said base, and a can engaging ring adjacent to said base, said can coupling cap configured to couple rigidly to said spray container;

said top lip comprising a locking ledge having a bearing surface facing away from said can engaging ring, a cam track having a bearing surface facing toward said can engaging ring, and a guide slot therebetween; and an actuator affixed to said conduit and dispersion nozzle and located concentrically within said can coupling cap sidewall, said actuator having a generally cylindrical body and at least one cam protruding radially from said generally cylindrical body into said top lip;

said at least one cam engaging said locking ledge bearing surface when said actuator is in a first rotary position relative to said can coupling cap and thereby blocked from axial movement toward said can engaging ring, engaging said cam track bearing surface when in a second rotary position relative to said can coupling cap and thereby driven toward said can engaging ring, and passing though said guide slot when rotated between said first and second rotary positions.

2. The spray control apparatus of claim 1, wherein said can engaging ring further comprises a segmented and discontinuous can engaging ring.

3. The spray control apparatus of claim 1, wherein said can coupling cap further comprises a plurality of reinforcing ribs of generally planar geometry radiating inwardly from said can coupling cap side wall and extending generally along said sidewall from adjacent said segmented can engaging ring to adjacent said top lip.

4. The spray control apparatus of claim 2, wherein said can coupling cap further comprises a plurality of reinforcing ribs of generally planar geometry radiating inwardly from said can coupling cap side wall and extending generally along said sidewall from adjacent said segmented can engaging ring to adjacent said top lip.

5. The spray control apparatus of claim 1, wherein said at least one cam moves said closer to said can engaging ring when in said second rotary position, said actuator thereby configured to control a spray container valve to adjust flow of said fluid and propellant out from said spray container.

6. A can coupling cap configured to engage with a spray control apparatus actuator and an aerosol can, comprising:

an outer perimeter;

an interior surface defining an interior space;

a base;

a sidewall rising from said base;

a top lip distal to said base; and a segmented can engaging ring adjacent to said base, said segmented can engaging ring configured to couple rigidly to said aerosol can; and a plurality of reinforcing ribs of generally planar geometry radiating inwardly from cap side wall and extending generally along said sidewall from adjacent said segmented can engaging ring to adjacent said top lip;

wherein said top lip further comprises a locking ledge having a bearing surface facing away from said can engaging ring, a cam track having a bearing surface facing toward said can engaging ring, and a guide slot therebetween.

7. The can coupling cap of claim 6, wherein individual ones of said plurality of reinforcing ribs are coplanar with a radial plane.

* * * * *